US012644287B2

(12) United States Patent
Iverson

(10) Patent No.: US 12,644,287 B2
(45) Date of Patent: Jun. 2, 2026

(54) STAIR NOSING

(71) Applicant: MACNEIL IP LLC, Bolingbrook, IL (US)

(72) Inventor: David S. Iverson, Oak Brook, IL (US)

(73) Assignee: MACNEIL IP LLC, Bolingbrook, IL (US)

( * ) Notice: Subject to any disclaimer, the term of this patent is extended or adjusted under 35 U.S.C. 154(b) by 153 days.

(21) Appl. No.: 18/672,935

(22) Filed: May 23, 2024

(65) Prior Publication Data

US 2025/0361727 A1 Nov. 27, 2025

(51) Int. Cl.
*E04F 11/16* (2006.01)

(52) U.S. Cl.
CPC ..... *E04F 11/163* (2013.01)

(58) Field of Classification Search
CPC ..... E04F 11/163; E04F 11/09; E04F 11/104; E04F 2011/1046
See application file for complete search history.

(56) References Cited

U.S. PATENT DOCUMENTS 1,611,211 A * 12/1926 Loehr ..... E04F 11/163 52/717.06
1,936,224 A * 11/1933 Awbrey ..... E04F 11/163 52/717.06
4,058,942 A * 11/1977 Naka ..... E04F 11/163 428/167
4,060,947 A * 12/1977 Naka ..... E04F 11/166 52/179
4,077,825 A * 3/1978 Naka ..... E04F 11/166 156/289
4,093,499 A * 6/1978 Naka ..... B29C 48/08 156/499
4,151,320 A * 4/1979 Naka ..... A47G 27/06 428/167
5,475,953 A * 12/1995 Greenfield ..... E04F 15/024 52/287.1
7,313,876 B2 * 1/2008 Morgan ..... A43B 13/223 36/59 R
10,258,104 B2 * 4/2019 Kraft ..... B29D 35/122
11,395,523 B2 * 7/2022 Nishiura ..... A43B 13/12
2013/0171419 A1 * 7/2013 Tyler ..... B60N 3/044 428/167
2015/0322678 A1 * 11/2015 Drevnig ..... E04F 11/163 52/179

FOREIGN PATENT DOCUMENTS

DE 914428 C * 7/1954
DE 3027862 A1 * 3/1982
DE 3433314 A1 * 7/1985
DE 3636874 A1 * 5/1988 ..... E04F 11/163

* cited by examiner

*Primary Examiner* — Adriana Figueroa
(74) *Attorney, Agent, or Firm* — Perkins IP Law Group LLC; Jefferson Perkins

(57) ABSTRACT

An injection molded stair nosing has a tread member, a front portion of which is downwardly and backwardly canted from the horizontal by about 5 to about 7 degrees. The front portion is supported by a plurality of spaced apart support ribs underneath the front portion. Each support rib may have a front concave surface to fit to a curved transition of a stair tread to a stair riser or nose. A back portion of the tread member is tapered to mitigate any interference with the foot or shoe of a user.

9 Claims, 7 Drawing Sheets

STAIR NOSING

BACKGROUND OF THE INVENTION

Conventional stairs have multiple steps, with each step having a horizontally disposed tread and a vertically disposed riser. Usually the dimensions of the tread and riser are uniform, one step to the next. A rearward edge of a tread ends in a vertical wall made by the next riser. A forward edge of the tread may be forwardly spaced from the vertical plane of the riser beneath it, making a prominent nosing. In other stairs, there is no such prominent nosing but merely a fairly abrupt transition between the forward end of the tread and the top end of the riser. There usually is a convexly curved transition between the horizontal tread surface and either the riser or the tread nose that forwardly projects beyond the riser beneath it.

It is known to install nosings of different materials on stair steps, including ones made of metal and plastic or other polymer. The nosing typically will have a tread member that covers some portion of the stair tread beneath it, and a riser member that will cover either the vertical face of the original nosing or some of the stair riser immediately beneath the tread. Such nosings typically are extruded, particularly as made from a polymer compound, such that a cross section taken anywhere along its length remains the same. Consumers typically cut these extruded nosings to a desired length, leaving sharp unfinished margins. The thickness of the tread members of conventional polymer nosings is substantially uniform, and the upper surface of such a tread member will generally conform to a horizontal plane that is upwardly spaced from the horizontal plane of the tread on which the nosing is installed.

SUMMARY OF THE INVENTION

According to one aspect of the invention, a nosing is provided that has an elongate tread member and an elongate riser member. A front end of the tread member is joined to an upper end of the riser member by a convex curved transition. The tread member has a front portion that rearwardly extends from the front end. A width of the front portion is less than half of a width of a tread member. An upper surface of the tread member, within the front portion of the tread member, downwardly slopes from the front end. An angle of the upper surface within the front portion relative to the horizontal may be in the range of about 5 degrees to about 7 degrees.

In one embodiment, the tread member has a back portion that frontwardly extends from the back end of the tread member. A thickness of the back portion decreases as the back end of the tread member is approached.

In one embodiment, the tread member further has a central portion that joins the front portion to the back portion. The central portion has a tread pattern formed thereon that may have a plurality of peaks and valleys.

In one embodiment, the nosing is attached to a tread and/or riser of a stair by way of one or more adhesive layers. For example, the general lower surface of the back portion may substantially conform to a horizontal plane. An adhesive layer, such as two-sided tape, is applied to this planar portion and is used to affix the tread member of the nosing to the upper surface of the stair tread. In similar fashion, an area of the rear surface of the riser member may be planar and vertically disposed, and an adhesive layer is applied to this area as well. The riser member is thereby attached to either a nose of the stair or to a riser thereof, depending on the nature of the stair.

According to another aspect of the invention, a stair nosing is integrally molded of an elastomer. The nosing has a tread member with a back end and a front end. An upper surface of the tread member is spaced from a general lower surface thereof. A riser member has a top end joined to the front end of the tread member by a curved transition, and a bottom end that is downwardly displaced from the top end. The tread member includes a front portion that is adjacent to the front end. An angle of the upper surface, when taken within the front portion of the tread member, may fall in the range from about 5 degrees to about 7 degrees. The general lower surface of the tread member is downwardly displaced from the upper surface of the tread member by a substantially constant thickness, as measured within the front portion of the tread member. A plurality of support ribs each downwardly extend from the general lower surface of the tread member. Each support rib has a lower edge. Most of each of these lower edges conform to a common horizontal plane and in use support the front portion of the tread member on a horizontal stair tread.

In one embodiment, the support ribs are spaced apart from each other. In one embodiment, the support ribs are parallel to each other and rearwardly extend from the front end of the tread member.

In a further aspect of the invention, a stair nosing is provided that has a tread member and a riser member. The tread member has a front end, a back end, an upper surface and a general lower surface. The riser member has a top end joined to the front end of the tread member by an upwardly convex curved transition, a bottom end downwardly displaced from the top end, a front surface and a general rear surface. A front portion of the tread member rearwardly extends from the front end of the tread member. At least within this front portion, a plurality of support ribs downwardly extend from the general lower surface of the tread member. Each support rib has a front end joined to the general rear surface of the riser member. Each support rib has a lower margin. Most of the lower margin of each support rib conforms to a common horizontal plane. A concave portion of the lower margin is adjacent to and transitions to the general rear surface of the riser member. The concave portion of the lower margin of the rib may thereby conform to a convexly curved transition located at a front end of a tread upon which the stair nosing is installed.

The stair nosing of the invention is made possible by the method of its manufacture. Instead of extruding polymer through a die of uniform cross-section, stair nosings according to the present invention are integrally molded in injection molds. A method of manufacture includes forming, in a mold surface of an injection mold, a plurality of spaced-apart grooves. After completion of the mold, it is closed and a molten polymer, such as a thermoplastic elastomer, is injected into it. This produces a stair nosing with spaced-apart ribs that each downwardly extend from a general lower surface of the tread member of the stair nosing. This is not possible in an extrusion manufacturing process.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
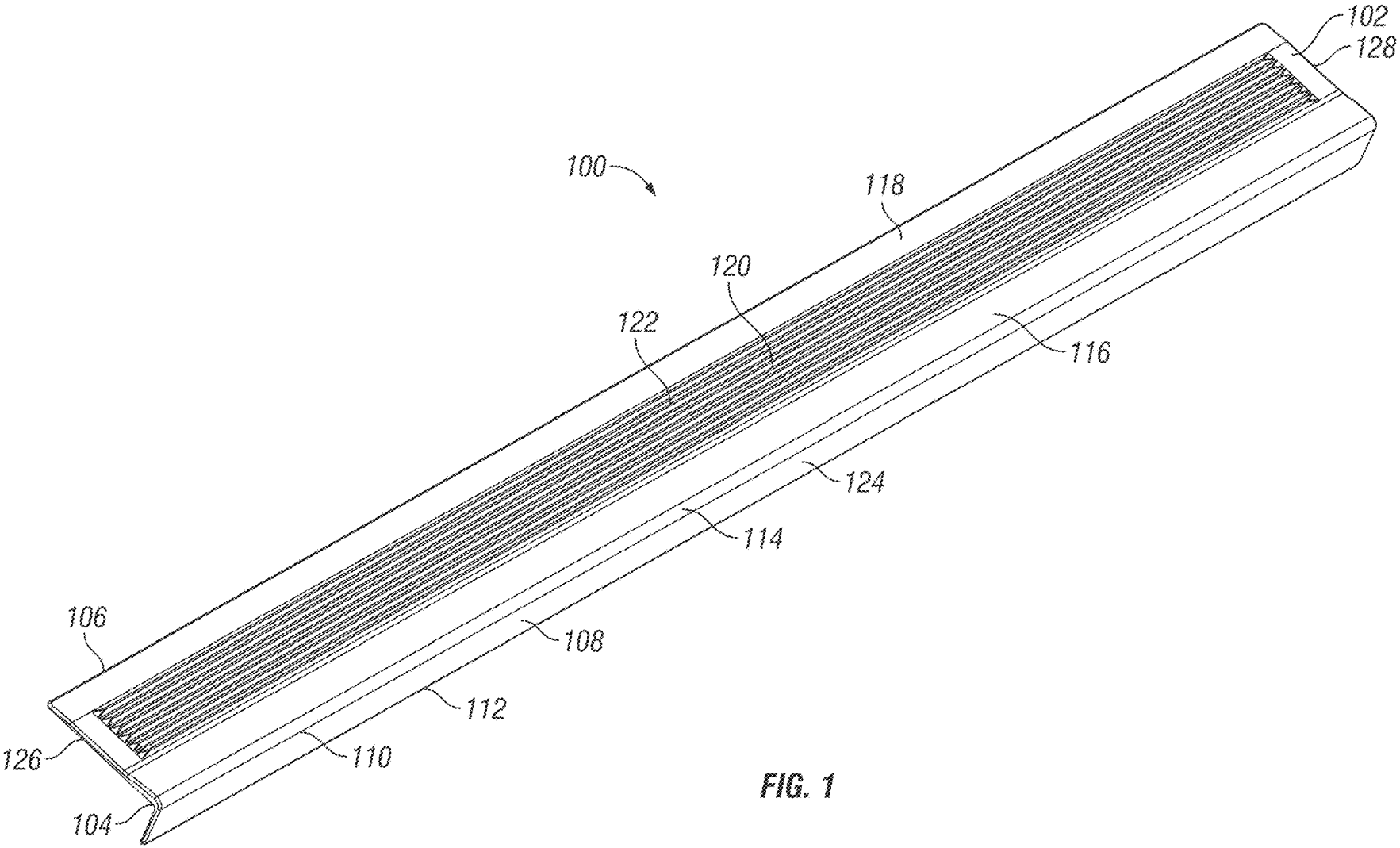
FIG. 1 is a top perspective view of a stair nosing according to the invention.

A stair nosing according to the invention is shown generally at 100 in FIG. 1. Nosing 100 has a tread member 102 with a front end 104 and a rear end 106. The other major component of nosing 100 is a riser member 108, which has a top end 110 and a bottom end 112 downwardly displaced from top end 110. The top end 110 of riser member 108 is joined to the front end 104 of tread member 102 by an upwardly and forwardly convex curved transition 114.

Tread member 102 has a front portion 116 that extends rearwardly from front end 104, a back portion 118 that extends forwardly from the rear end 106, and a central portion 120 that is disposed between and joins the front portion 116 and back portion 118. Visible in FIG. 1 is an upper surface 122 of the tread member 102, and a forward surface 124 of the riser member 108.

The nosing 100 is elongate, and the illustrated embodiment is 29½ inches long from a left end 126 to a right end 128. In other, nonillustrated embodiments, the length is different, such as 35.5 in. or 44 in., but the structure of nosing 100 otherwise is substantially the same. Because the nosing 100 is injection-molded rather than extruded, the left end 126 and the right end 128 may be finished with pleasing curved transitions instead of the unfinished sharp corners that would be left by a knife or scissors after a consumer cuts an extruded nosing to length.

For the purposes of this Specification, the "width" of the tread member 102 is a horizontal distance parallel to a width direction, from back to front, and the "length" of tread member 102 and riser member 108 is a horizontal distance parallel to a length direction, from left end 126 to right end 128. A "thickness" of tread member 102 is vertical, while a "thickness" of riser member 108 is measured in the width direction.

Figure 2:
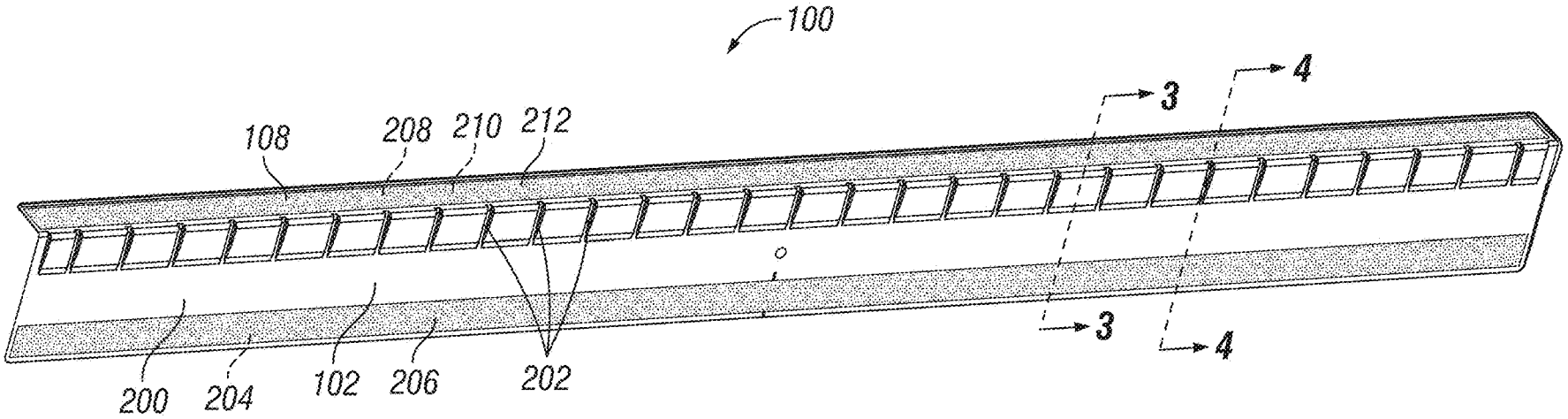
FIG. 2 is a bottom perspective view of the stair nosing shown in FIG. 1.

As seen in FIG. 2, the tread member 102 has a general lower surface 200 from which each of a plurality of spaced-apart support ribs 202 downwardly extends (upwardly in this view). The support ribs 202 may be parallel to each other and aligned to the width direction. At least a portion 204 of the general lower surface 200 is flat and horizontal, and provides a site to which a strip 206 of double-sided adhesive tape may be applied. Similarly, the riser member 108 has a general rear surface 208. At least a portion 210 of the general rear surface is planar or flat and (in use) vertical, and provides a site to which another strip 212 of double-sided adhesive tape may be applied. Tape strips 206, 212 are respectively used to adhere tread member 102 to an underlying stair tread, and to adhere riser member 108 to an underlying stair tread nose or riser. Tape strips 206 and 212 have been removed from the other views of the drawings for the purpose of clarity.

Figure 2A:
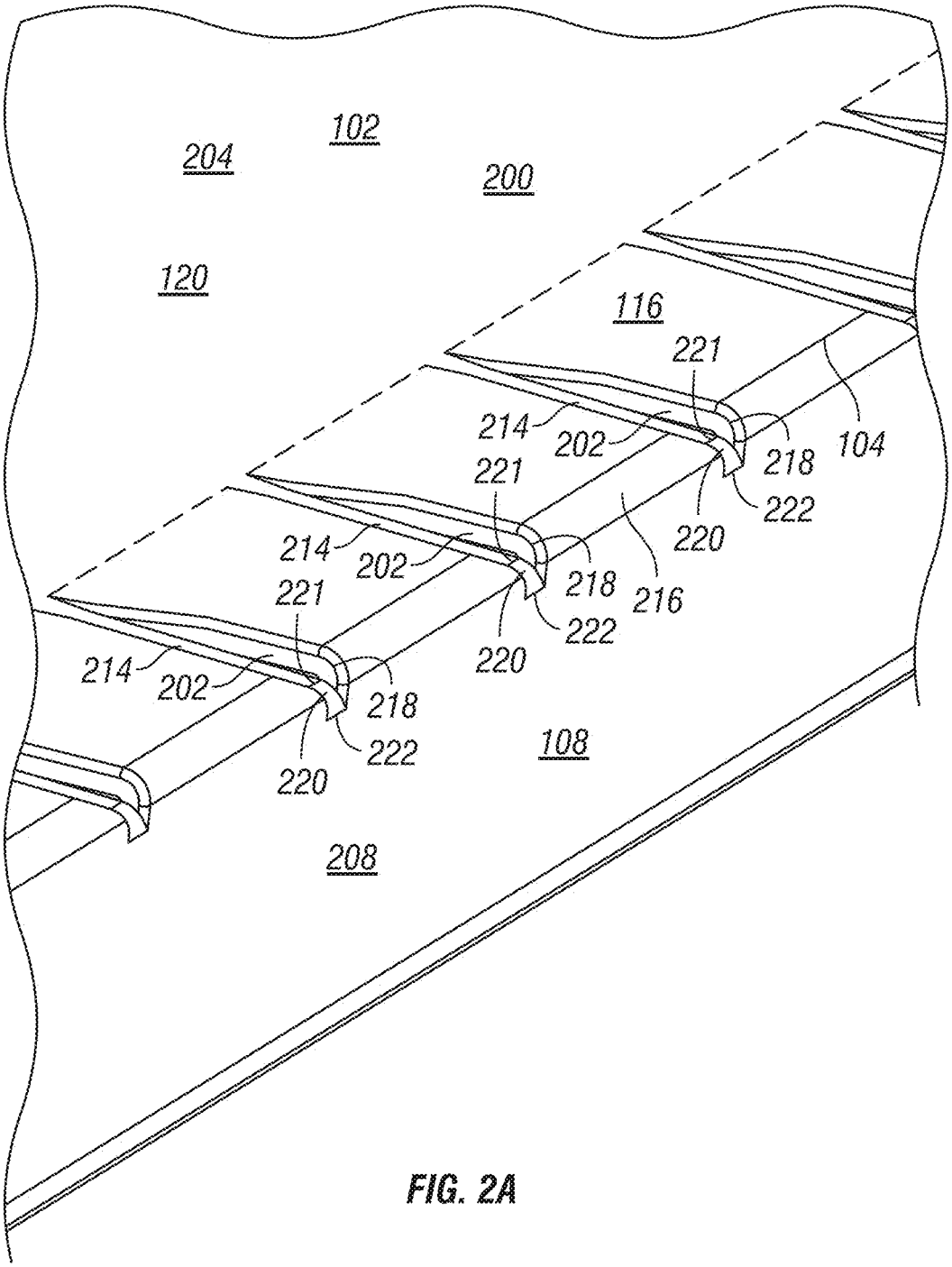
FIG. 2A is an enlarged bottom perspective detail of FIG. 2, showing details of the support ribs.

As seen in FIG. 2A, each support rib 202 has a lower margin or edge 214. Most of each lower margin 214 conforms to a common horizontal plane P (FIG. 4), as does area 204 of the general lower surface 200. But, within front portion 116 of the tread member 202, the general lower surface 200 does not conform to a horizontal plane but rather is canted upwardly and forwardly until front end 104 is met. A downwardly and rearwardly concave curved transition 216 connects general lower surface 200 to the general rear surface 208 of the riser member 108.

The support ribs 202 are relatively thin in the lengthwise direction, and in one embodiment are 0.060" thick. Ribs 202 may be spaced apart from each other with a spacing in the range 0.75 in. to 1.25 in., and in the illustrated embodiment they are spaced from each other at 1 inch centers. The spacing will depend on the polymer used to mold nosing 100. The ratio of rib thickness to the voids in between the ribs is quite small, and in the illustrated embodiment is about 0.06. This spacing insures that several support ribs 202 will be available to take the downward load of a foot or shoe of a person using the stairs.

Each support rib 214 terminates at its front end with a concave portion or fillet 218. The lower surfaces 220 of concave portions 218 are meant to conform to the most common convex curved transition of a stair tread to a vertical nose or riser. The lower surface 220 of each concave portion 218 has a back end 221 that is continuous with lower margin 214, and a lower end 222 which merges with riser member general rear surface 208. A radius of surface 220 may be chosen to be in the range of 0.01 in. to 0.125 in., and may be 0.06 in.

Figure 3:
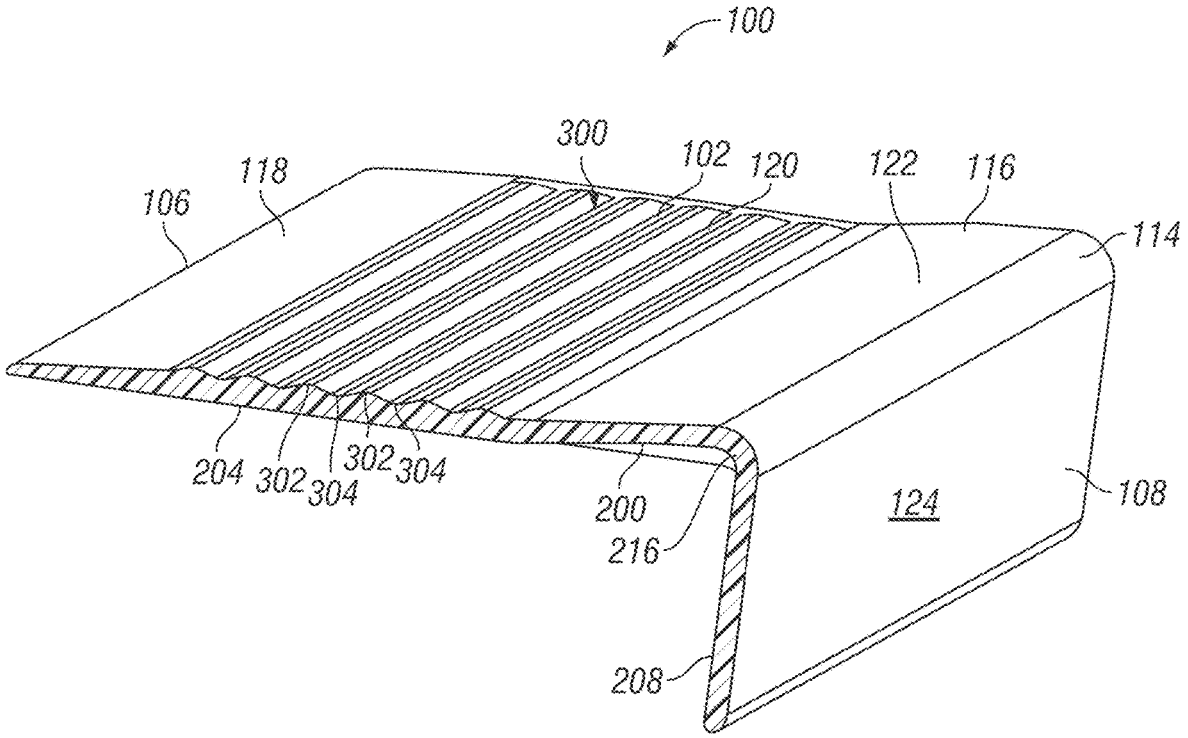
FIG. 3 is a cross section taken substantially along line 3-3 of FIG. 2.

FIG. 3 is a cross-sectional view taken at place along the length of nosing 100 in between support ribs 202. Most portions of tread member 102 and riser member 108 conform to a predetermined nominal thickness for best injection molding practice. This nominal thickness will vary according to the polymer used to mold the part and may be selected from the range of about 0.07 in. to about 0.09 in. In the illustrated embodiment, the nominal thickness is 0.08 in.

A thickness of the front portion 116 of tread member 102 between upper surface 122 and general lower surface 200 may be uniform and may be 0.08 in. A thickness of riser member 108 between the front surface 124 and general rear surface 208 likewise may be uniform and may be 0.08 in. A thickness of the tread member 102 between upper surface 122 and general lower surface 200, as measured within central portion 120, will vary because of the corrugations 300 within central portion 120. In the illustrated embodiment, the corrugations 300 are composed of a lengthwise parallel series of peaks 302 and valleys 304. The thickness of each of the valleys 304 may be about 0.08 in., and the thickness of the peaks 302 may be greater than this, such as 0.105 in.

Figure 4:
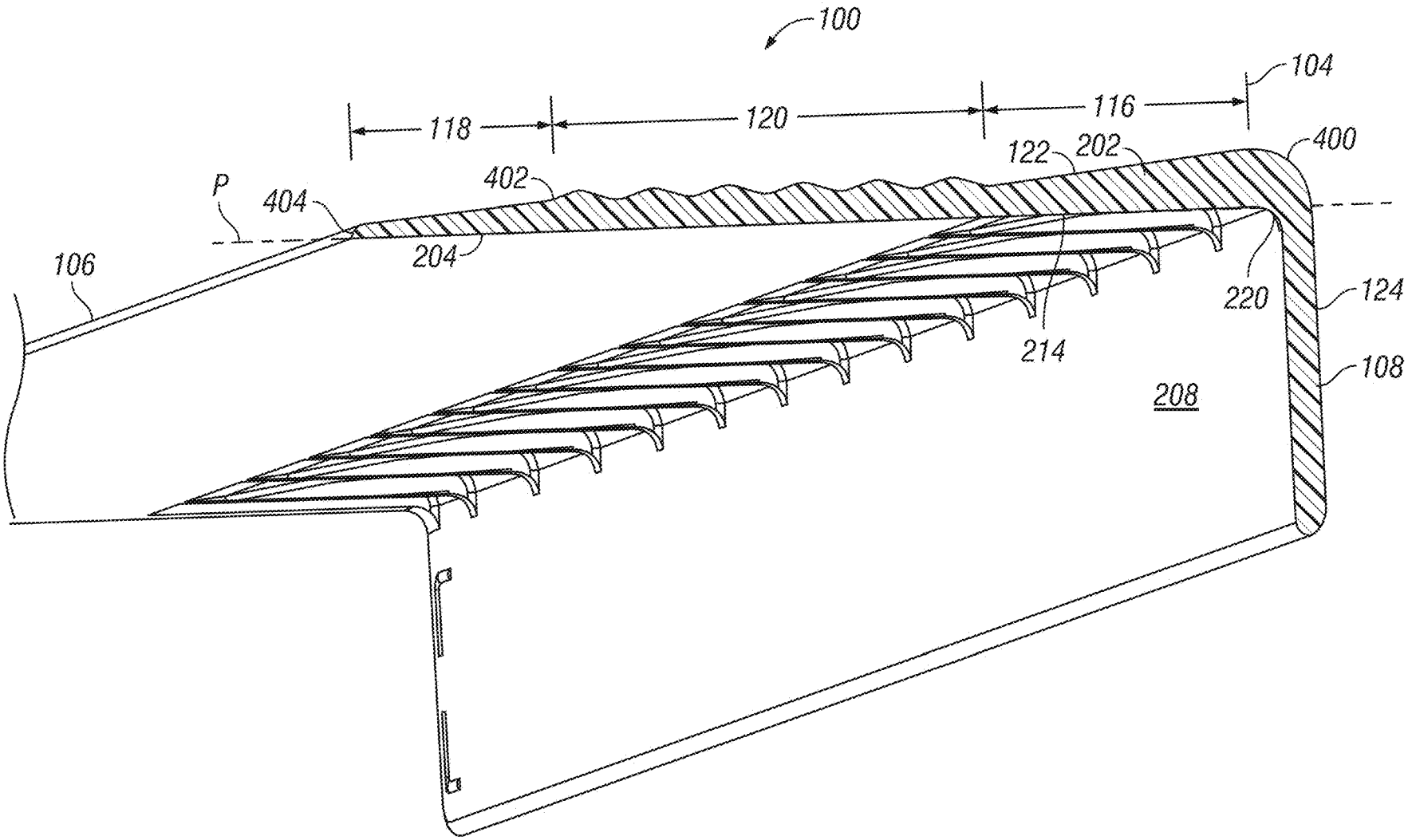
FIG. 4 is a cross section taken substantially along line 4-4 of FIG. 2.

FIG. 4 is a cross section taken in the same plane as a representative one of the support ribs 202. Except for concave surface 220, the support rib lower margin or edge 214 conforms to horizontal plane P, as does area 204 of general lower surface 200 within central portion 120 and back portion 118. Once nosing 100 is installed, the plane P will be coplanar with the upper surface of the stair tread.

Within front portion 116, the upper surface 122 of tread member 102 is downwardly and rearwardly canted from front end 104. The angle of this surface may be chosen to be within the range of 5 to 7 degrees with respect to the horizontal. In one embodiment, the upper surface 122 within portion 116 may be planar. In another embodiment, the upper surface 122 within portion 116 may be upwardly convexly curved about a large radius, such as at least about 74 mm or 2.9 in. In that instance, the angle of the surface 122 may be specified measuring the angle of a chord drawn between between the back and front end points of the curve. A convex surface 400 transitions between upper tread member surface 122 and forward surface 124 of riser member 124. A radius of convex surface 400 may be 0.156 in.

Since, within front portion 116, the tread member upper surface 122 is upwardly displaced by a uniform distance from general lower surface 200, the ribs 202 act to prop up and angle the upper surface 122 within the front portion 116. This is done to afford an ergonomic advantage to a person using the stairs, and provides a limited amount of cushionability to the front of the tread that nosing 100 will cover. In general, the design of stairs is very uniform and there are even building codes constraining any variation. In general, the treads of the stairs are always built to be as horizontal as possible. When a stair tread is not level, it is usually quite noticeable to the user because anything else is very uncommon. By giving a very slight angle to only the front portion of the stair nosing, the user will feel this in their step and, as it is angled downwardly toward the riser, it is intended to give the user a feeling or sense that his or her foot will not slip off the front of the step or edge.

A thickness of back portion 118, at forward end 402 thereof, is the same as the nominal thickness used for the rest of the nosing 100, such as 0.08 in. But the thickness of back portion 118 decreases as the rear end 106 is approached. End 106 may have a terminating convexly curved surface 404 with a small radius, such as 0.03 in. to 0.04 in., and in the illustrated embodiment 0.036 in., and this may be the thickness of portion 118 immediately adjacent surface 404. This diminution in thickness mitigates against end 106 being caught by a user's shoe or foot, thereby reducing any tripping hazard. Within portion 118, the upper surface 122 of tread member 102 may be planar, or may be upwardly convexly curved around a large radius, such as about 75 mm. Where surface 122 within portion 118 is convex, an angle of surface 122 may be estimated by the angle of a chord drawn across its front and rear end points.

The width of front portion 116 may be less than one-half the overall width of nosing 100. In one embodiment, the width of portion 116 may be about 0.8 in., the width of central portion 120 may be about 1.1 in., and the width of back portion 118 may be about 0.63 in.

Figure 5:
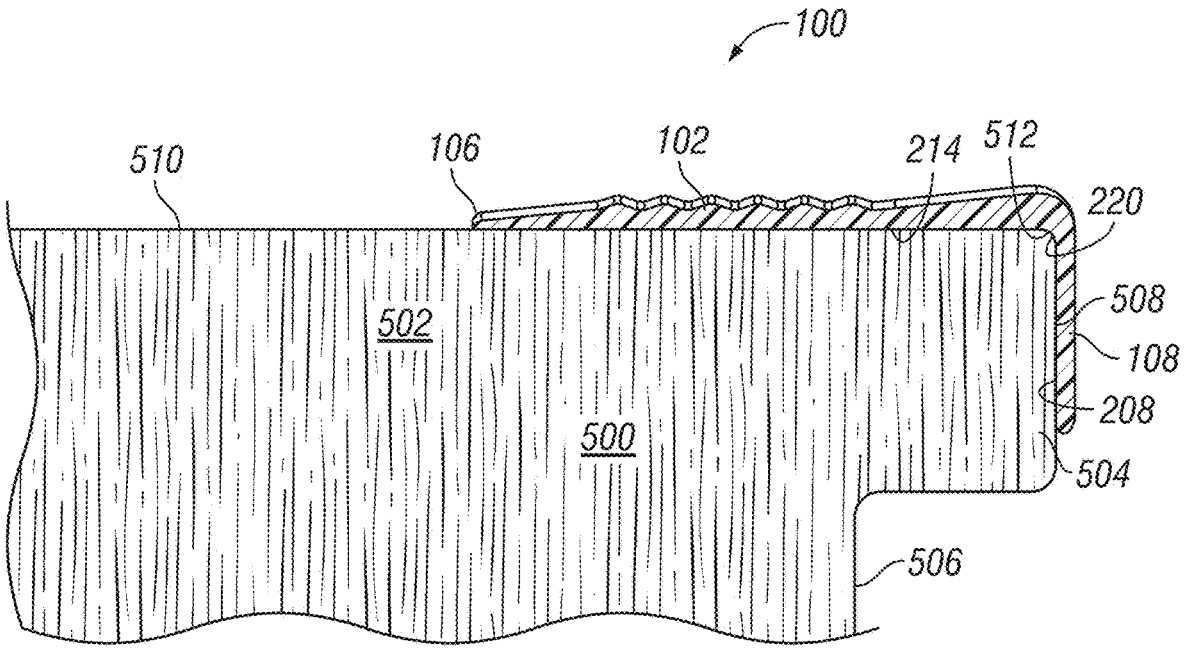
FIG. 5 is a cross-section similar to FIG. 4, showing a nosing installed on a stair whose treads have a prominent nose.

FIG. 5 is a schematic sectional view of a nosing 100 as installed on a step of a staircase 500. A tread 502 of staircase 500 terminates at its forward end in a prominent nose 504, which is positioned forwardly of a riser 506 below it. Rear surface 208 of the riser member 108 is adhered to the vertical surface 508 of nose 504, while bottom surface 204 of tread member 102 is adhered to horizontal surface 510 of tread 502. A depth of the riser member 108, such as 0.87 in. as measured from surface 220, is selected to be less than the depth of common stair nosings, so that there will be no overhang.

Horizontal stair surface 510 will join vertical stair surface 508 with a convex curved transition 512. The radius of surface 220 is selected to fit to the most common radius for transition 512.

Figure 6:
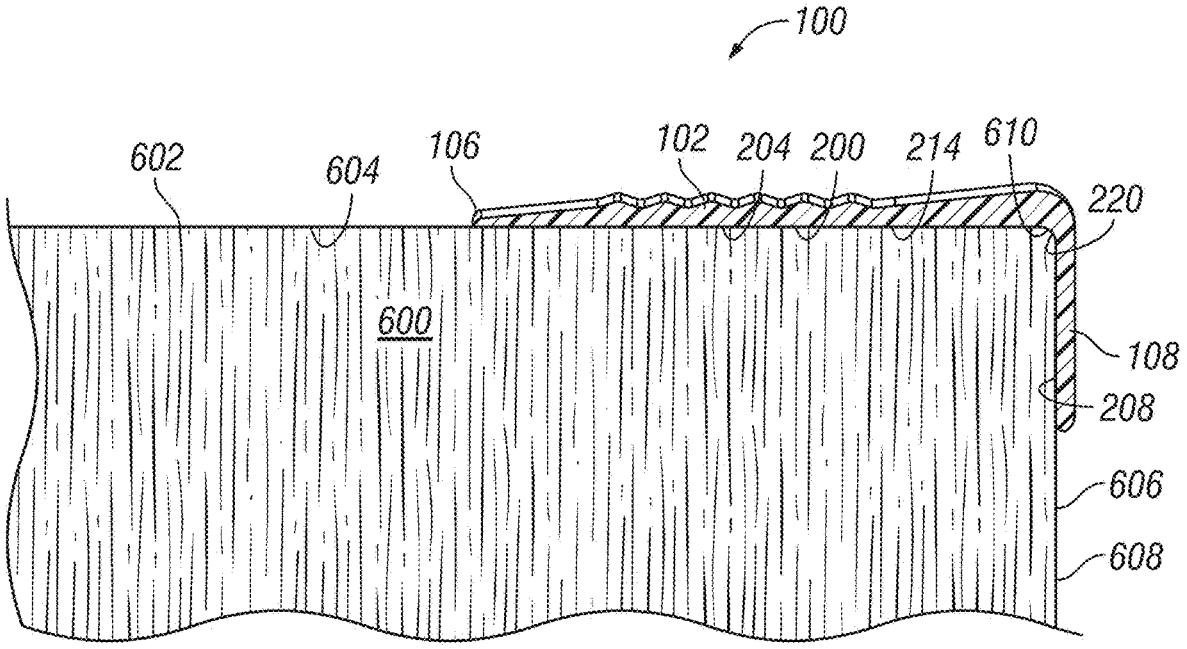
FIG. 6 is a cross section similar to FIG. 4, showing a nosing installed on a stair whose treads make direct transitions to vertical risers.

FIG. 6 is a schematic sectional view of a nosing 100 as installed on a step of a staircase 600. A horizontal surface 602 of a stair tread 604 makes a direct transition to a vertical surface 606 of a riser 608, with no forwardly extending nose. Rear surface 208 of riser member 108 is adhered to vertical surface 606 of the riser 608. Flat portion 204 of general lower surface 200 is adhered to horizontal surface 602 of tread 604. Surface 604 makes a convex curved transition 610 to vertical surface 606, and the radius of surface 220 is chosen to match the most common radius of curved transition 610.

Figure 7:
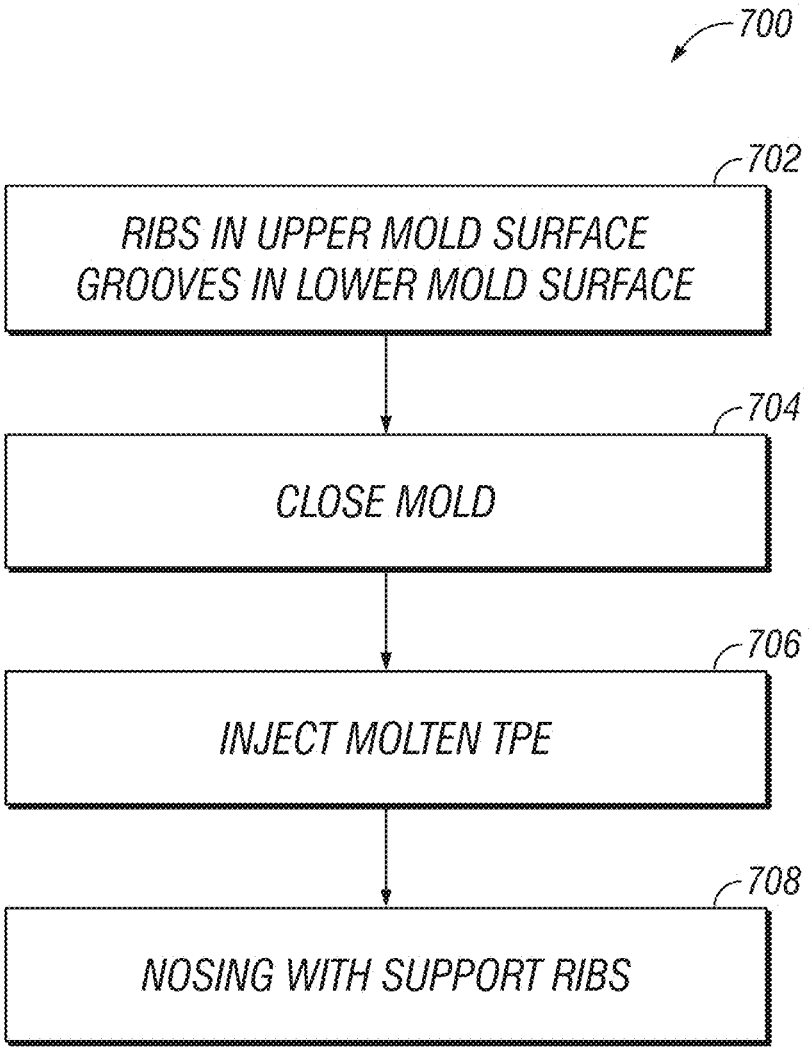
FIG. 7 is a block diagram of a method of manufacturing the stair nosing of the invention.

FIG. 7 illustrates steps in a manufacturing process 700 for stair nosing 100. At step 702, and during the process of designing a mold for nosing 100, parallel spaced-apart grooves are formed in the upper surface of a lower mold half. At the same time, ribs or other corrugations are formed in the lower surface of an upper mold half. At step 704 the mold is finished and closed. At step 706, a molten polymer such as a thermoplastic elastomer (TPE) is injected into the mold. The TPE may be a styrenic block copolymer. The TPE used may produce an integrally molded part having a Shore A hardness of about 85, as measured with a 10-second delay. The polymer selected also should have a high coefficient of friction relative to feet and footwear. At step 708, the mold is opened. The part as molded will have support ribs 202. Producing a stair nosing by injection molding makes possible a nosing 100 with a nonprismatic shape; the cross section of nosing 100 may vary from one location along its length to the next. This permits the molding of support ribs 202 whereas an extruded stair nosing could not have these structures.

In summary, a stair nosing has been illustrated and described that uses support ribs within a front portion to cant an upper surface of a tread member from the horizontal. The support ribs have concave surfaces which will fit to common curved transitions between stair treads and risers or the vertical faces of noses. A rear end of the part is tapered to mitigate the hazard of tripping.

While illustrated embodiments of the present invention have been described and illustrated in the appended drawings, the present invention is not limited thereto but only by the scope and spirit of the appended claims.

I claim:

1. A stair nosing integrally molded of an elastomer and comprising:

a tread member having a back end and a front end, an upper surface of the tread member spaced from a general lower surface thereof;

a riser member having a top end joined to the front end of the tread member by a convexly curved transition and a bottom end downwardly displaced from the top end;

the tread member including a front portion adjacent to the front end, an angle of the upper surface when taken within the front portion being in the range of about 5 degrees to about 7 degrees;

the general lower surface of the tread member being downwardly displaced from the upper surface of the tread member by a substantially constant thickness when measured within the front portion of the tread member; and a plurality of support ribs each downwardly extending from the general lower surface of the tread member within the front portion thereof, each support rib having a lower edge, most of each of the lower edges of the support ribs conforming to a common horizontal plane and operable to support the front portion of the tread member on a horizontal stair tread, wherein the support ribs are spaced apart from each other and are parallel to each other, and wherein each support rib rearwardly extends from the front end of the tread member.

2. The stair nosing of claim 1, wherein the support ribs are spaced apart from each other by a spacing in the range of about 0.75 to about 1.25 in.

3. The stair nosing of claim 1, wherein the support ribs have a thickness at right angles to the width of the tread member, a ratio of the thickness of the support ribs to the spacing between the support ribs being about 0.06.

4. A stair nosing comprising:

a tread member having a front end, a back end, an upper surface and a general lower surface;

a riser member having a top end joined to the front end of the tread member by an upwardly convex curved transition and a bottom end downwardly displaced from the top end, the riser member having a front surface and a general rear surface;

the tread member having a front portion rearwardly extending from the front end of the tread member, a plurality of support ribs downwardly extending from the general lower surface of the tread member at least within the front portion of the tread member, each support rib having a front end joined to the general rear surface of the riser member;

each support rib having lower margin, most of the lower margin conforming to a common horizontal plane, a concave portion of the lower margin disposed adjacent to and transitioning to the general rear surface of the riser member, whereby the concave portion of the lower margin of each support rib may conform to a convexly curved transition located at a front end of a tread on which the stair nosing is installed.

5. The stair nosing of claim 4, wherein a radius of the concave portion of the lower margin of each support rib is in the range of about 0.01 to about 0.125 in.

6. The stair nosing of claim 5, wherein the radius is about 0.06 in.

7. The stair nosing of claim 4, wherein the support ribs are spaced apart from each other, are arranged in parallel to each other, and rearwardly extend from the general rear surface of the riser member.

8. The stair nosing of claim 4, wherein the upper surface of the tread member within the front portion is downwardly sloped from the front end, an angle of the upper surface within the front portion being in the range of about 5 to about 7 degrees.

9. The stair nosing of claim 8, wherein the upper surface of the tread member within the front portion is a convexly curved surface having a radius of at least 2.9 inches.

* * * * *